United States Patent [19]

Hyer

[11] Patent Number: 4,522,500

[45] Date of Patent: Jun. 11, 1985

[54] WALL-MOUNTED AGITATOR FOR PARTICULATE MATERIAL

[75] Inventor: Frank S. Hyer, Duxbury, Mass.

[73] Assignee: Hyer Industries, Inc., Pembroke, Mass.

[21] Appl. No.: 563,285

[22] Filed: Dec. 19, 1983

[51] Int. Cl.[3] ..... B01F 11/00

[52] U.S. Cl. ..... 366/113; 222/198; 222/199; 366/114

[58] Field of Search ..... 366/110–115, 366/116, 124, 127; 222/198, 199; 29/235

[56] References Cited

U.S. PATENT DOCUMENTS

| | | | |
|---|---|---|---|
| 3,301,535 | 1/1967 | Brown | 366/113 |
| 3,544,073 | 12/1970 | Bodine | 366/113 |
| 3,715,059 | 2/1973 | Hyer | 366/113 X |

*Primary Examiner*—Timothy F. Simone

*Attorney, Agent, or Firm*—Kenway & Jenney

[57] ABSTRACT

A wall-mounted agitator for particulate material having an agitator panel within a gravity conveying wall for the material and a frame with a vibrator external to the wall and attached to the panel by means of resilient mounts. The mounts each include annular flange means for attachment to an aperture in the wall and an elastic annulus of sleeve-like form. The annulus extends from the flange means to the panel and frame, respectively, in opposite directions.

12 Claims, 4 Drawing Figures

WALL-MOUNTED AGITATOR FOR PARTICULATE MATERIAL

SUMMARY OF THE INVENTION

This invention relates generally to agitators for improving the flow of particulate material by gravity along a conveying wall surface. More particularly, it concerns improvements in the structures for resiliently mounting an agitator on a wall conveying such material.

U.S. Pat. No. 2,905,365 issued to Thayer et al discloses a gravity-fed hopper having an agitator assembly comprising an internal agitator screen operatively driven by an external vibrator to prevent the arching of particulate material over the hopper outlet. The assembly comprising the agitator and vibrator is resiliently supported on the hopper wall by sleeve-like rubber bushings that extend outwardly of the external surface of the hopper and attach to the vibrator frame. U.S. Pat. No. 3,715,059 issued to the present applicant discloses improvements in that agitator assembly including structures for resiliently opposing the gravitational forces applied to the assembled agitator and vibrator, thereby relieving or reducing the stresses on the rubber or other elastomeric bushings caused by those forces. Also, according to the latter patent the bushings are arranged to extend inwardly to an attachment with the agitator rather than outwardly to an attachment with the vibrator, whereby the component of gravitational force that is normal to the hopper wall is directed to cause compression in the bushings rather than tension, with a consequent improvement in the durability and life of the bushings.

Agitators of the foregoing types are intended to operate so that the agitator panel in contact with the particulate material, typically in the form of a screen, undergoes reciprocal translational movement parallel to the sloping gravity conveying wall for the material. This motion is capable of breaking up an arch of the material that is likely to form above a hopper outlet, and of preventing the adhesion and packing of particulate material to or on the wall, thereby allowing the material to flow uniformly toward the outlet. In order to produce the desired reciprocal motion, a vibrator is attached to the external frame of the agitator assembly and arranged to impart predominantly translational vibratory motion in the direction parallel to the conveying wall for the material. The mounting bushings, which are typically of sleeve-like configuration and preferably tapered toward one end, are elastic and adapted to accommodate the reciprocal motion in that direction. For the purposes of this application, the direction parallel to the conveying wall for the particulate material is referred to as the "parallel" direction.

In practice, however, it has been found that in addition to the intended motion of the agitator panel in the parallel direction, vibratory motion may be produced in the direction normal to the parallel direction, hereinafter called the "normal" direction. For example, in agitator assemblies incorporating pneumatic vibrators such normal motion may result from vibration in a certain frequency range or from the application of excessive air pressure to the vibrator motor. Other types of vibrators such as various electrically actuated forms also produce components of normal vibration under certain conditions of operation. In cases where plural agitator assemblies are mounted near one another, for example in annularly spaced relationship around the same hopper, vibratory disturbances from one agitator may induce normal vibratory motion in another agitator. A still further cause for normal vibratory motions may be the lodging of a lump of the particulate material between the agitator panel or screen and the wall of the hopper or other gravity conveying wall. Also, the location of the vibrator motor in relation to the other parts of the agitator assembly results in a reversing couple on the mounted assembly that induces a component of reciprocal movement in the normal direction.

In structures presently in use, motions that cause tensile stress in the mounting bushings, which are typically made of rubber or rubber-like material, have an important effect on the durability and expected life of the bushings. In these structures a rubber bushing typically has a metal washer bonded to or embedded in each of its ends, one of the washers being adapted for attachment to the hopper wall and the other washer being adapted for attachment to the agitator assembly. Tensile stress applied to the bushing through a washer can cause a failure of the bond between the washer and the bushing. Also, as the bushing strains in tension, the cross-sectional area of the elastomer decreases, and therefore the application of tensile force to a decreasing cross-sectional area causes an increasing magnitude of tensile stress.

In the structures of either of the above-identified patents, a reciprocal normal motion of the agitator assembly may be opposed for substantial time intervals by tensile stress in the bushings in one or the other of the directions of reciprocal motion. In the other direction the bushing is under compression which does not adversely affect the bond between the elastomer and the washers. Also, compression increases rather than decreases the cross-sectional area of the elastomer, thereby tending to reduce the compressive stress.

It is a principal object of this invention to reduce tensile stresses on the bushings, thereby increasing their useful life.

A second object is to permit the use of a wider variety of elastomers, and especially to permit the use of lower durometer elastomers that would be impractical to employ in prior types of agitator assemblies.

A third object is to provide improvements in agitator mounting assemblies that will facilitate the replacement of failed or damaged bushings, especially by enabling replacements to be deferred until occasions when the hopper or other gravity conveying wall does not contain particulate material.

With the foregoing and other objects in view, the features of this invention include the provision of improved mounts for agitator assemblies. An improved mount includes annular flange means adapted for attachment to the material conveying wall about an aperture therein, and an elastic annulus of sleeve-like form that extends therefrom in opposite directions to opposing surfaces of the internal agitator panel and the external frame, respectively. By means of this arrangement, it is ensured that the elastic annulus has a portion if not the entirety thereof undergoing compressive stress at every stage of the normal reciprocal movement in both directions. The portion of the annulus which at any given time is under compressive stress assumes a substantial fraction of the normal force load on the bushing, thereby reducing the tensile force load on any portion thereof that is then undergoing a tensile stress.

A second feature of the invention is applicable to embodiments like those described in the above-mentioned patents, having metallic washers bonded to the elastomer. Since the invention allows a reduction in or the complete elimination of intervals of tensile stress in the elastomer, there is a reduction in the degree of separation of the elastomeric material from the washers. Failures caused by such separation have been the most frequent failures in the mounts of agitators of this general type.

Another feature of the invention resides in the use of two separate bushings for each of the mounts, the two bushings together comprising the elastic annulus of the invention. If desired, these bushings may be of identical structure. In the event that one of the bushings should fail, the other bushing continues to provide a seal preventing the escape of particulate material from the hopper. If a failure is noticed in the outside bushing, it can be replaced without having to empty the hopper. Further, during replacement of the outer bushing, the inner bushing may be visually observed, and replacement of the latter if necessary can be scheduled to take place when the hopper is empty.

A further feature of the invention resides in the configuration of the parts which enables them to be retrofitted easily to existing agitator installations of the types disclosed in the above-mentioned patents.

Other features of the invention reside in certain details, arrangements and interrelationships of the parts of the assembly which will be more readily understood from the following description and the appended drawings.

DRAWINGS

DETAILED DESCRIPTION

Figure 1:
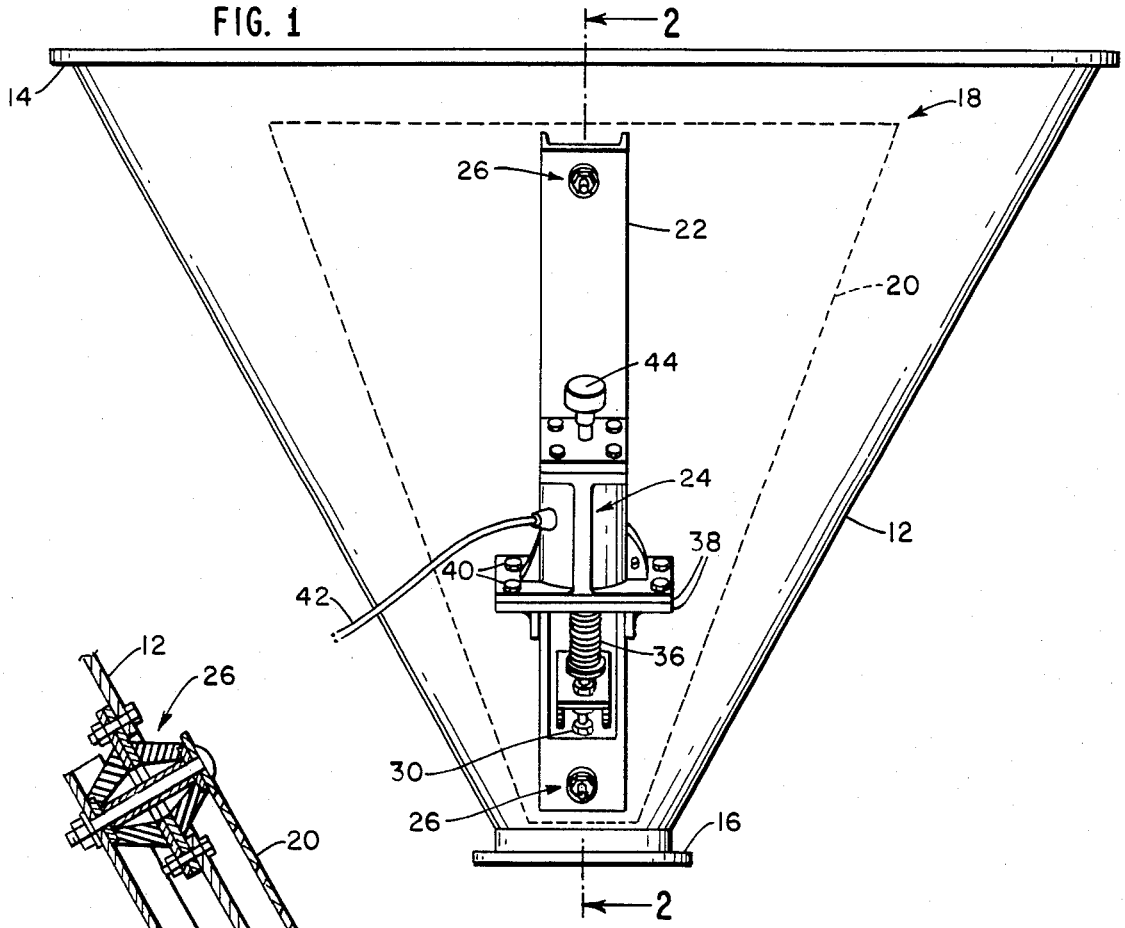
FIG. 1 is an elevation showing a hopper provided with an agitator assembly embodying the presently preferred embodiment of the present invention.
Figure 1:
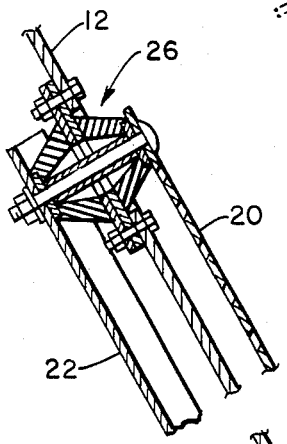
Figure 2:
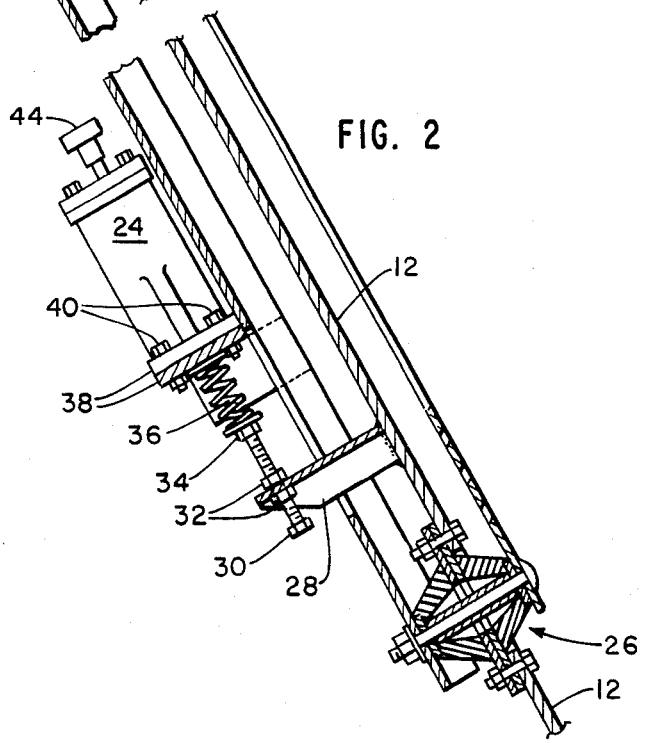
FIG. 2 is an elevation in section taken on line 2—2 of FIG. 1.

FIG. 1 shows a sheet metal hopper including a sloping wall 12 having a flange 14 at its upper end for attachment to a bin and a flange piece 16 at its lower end forming a circular outlet. In general accordance with the teachings of the above-mentioned patents, there is provided an agitator assembly for particulate material flowing by gravity in the hopper, this agitator assembly being designated generally at 18. The principal parts of the agitator are an agitator panel 20 situated internally of the hopper, an agitator frame 22 of suitable size and shape situated externally of the hopper and having a powered vibrator motor 24 rigidly mounted thereon, and mounts 26 attaching the panel 20 and frame 22 together in spaced relationship and being adapted to support them resiliently on opposite sides of the wall 12. In the illustrated embodiment there are two mounts 26, but an additional mount or mounts may be provided according to the size and shape of the frame used, and in certain embodiments known to the art only a single mount may be used. The agitator panel 20 may be in the form of a screen, an expanded metal sheet or any other form provided in agitators of this general type, as will be apparent from the following description.

A bracket 28 is secured to the wall 12, for example by welding. The bracket 28 has an adjusting screw 30 threaded to it with a pair of locking nuts 32, the end of the screw having a platform 34 thereon. A compression spring 36 extends between the platform 34 and one end of the vibrator motor 24. In practice, the screw 30 is adjusted to apply sufficient compression to the spring 36 to produce a force substantially equal to that component of the gravitational force operative on the agitator assembly that is in the parallel direction as above defined. This gravitational force results from the weight of the particulate material on the panel 20 and the mass of the agitator assembly itself.

As shown, the frame 22 comprises a channel member to which the vibrator motor 24 is secured by means of suitable brackets 38 and bolts 40. Alternatively, a frame of a different configuration may be provided for the practice of this invention. The vibrator motor shown for purposes of illustration is of the pneumatic type, and is connected by suitable tubing 42 to a source of pneumatic pressure. The vibrator is of conventional construction and is provided with an exhaust muffler 44. It will be apparent from the following description that vibrators of other than pneumatic form may also be used in the practice of the invention.

Figure 3:
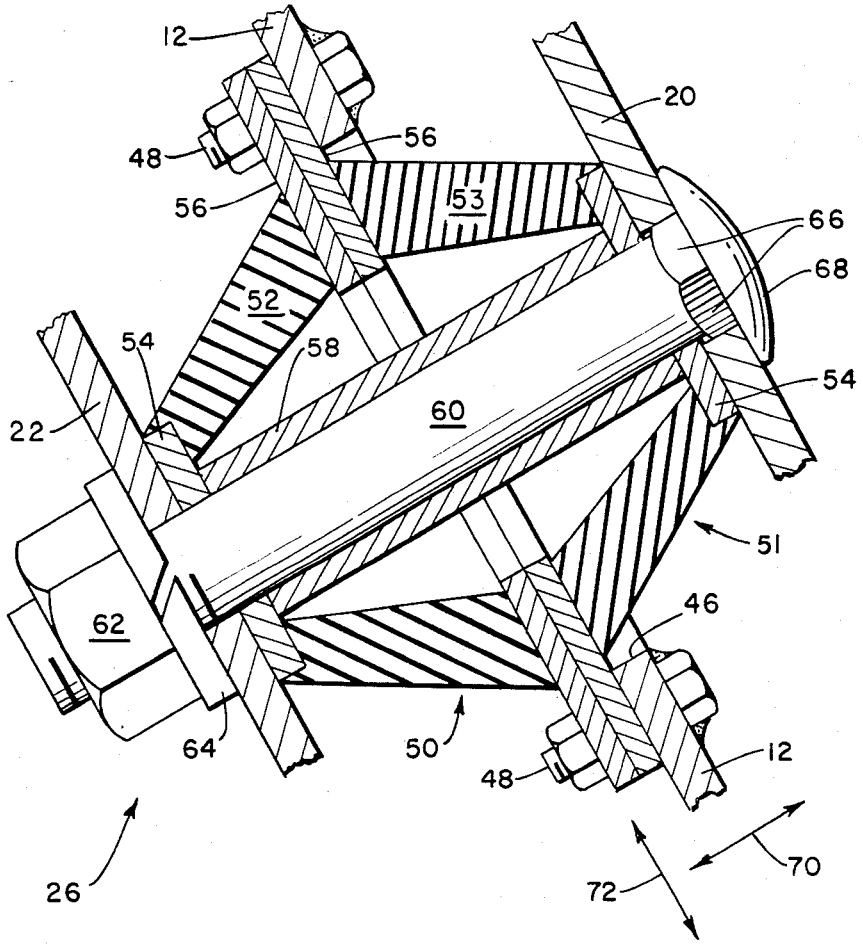
FIG. 3 is an enlarged fragmentary cross-sectional elevation showing details of the bushing assembly of FIGS. 1 and 2.

The structure of the mounts 26 is shown in detail in FIG. 3. For assembly of each mount to the hopper wall 12 the latter has a circular aperture 46. Adjacent the aperture a pair of drill holes are formed in the hopper wall for receiving mounting bolts 48.

A pair of identical annular, coaxial, mutually abutting bushings 50 and 51 are shown. The bushings comprise sleeve-like bodies 52 and 53 of rubber or other elastic material molded or adhesively bonded at one end to a metallic washer 54 and at the other end to a metallic washer 56. The washers 56 are assembled in mutually abutting relationship and secured to the hopper wall 12 by the bolts 48. The washers 54 respectively abut the mutually facing sides of the panel 20 and frame 22. A cylindrical metallic spacer sleeve 58 extends between and in abutting relationship to the washers 54. A bolt 60 passes through the panel 20, the washers 54, the sleeve 58 and the frame 22, and is provided with a nut 62 and locking washer 64. Preferably, the bolt 60 has a number of flats 66 on the shank adjacent its head 68, these flats being received in a correspondingly shaped aperture in the panel 20 so that the bolt 60 will not rotate when the nut 62 is tightened. This facilitates the tightening of the nut when the interior of the hopper is not readily accessible by a wrench or similar tool.

The washers 56 are mounted to the external surface of the hopper wall 12, thereby permitting the assembly and replacement of both of the bushings 50 and 51 from a position external to the hopper.

Arrows 70 in FIG. 3 illustrate the normal direction of motion of the agitator assembly. Arrows 72 illustrate the parallel direction of motion.

It will be seen, therefore, that each mount comprises the bolt 60, the sleeve 58, and support means that surround the sleeve. The support means include annular flange means 56 adapted for attachment to the wall of the hopper 12 about the aperture 46, an elastic annulus comprising the rubber or rubber-like bodies 52 and 53 of the two bushings 50 and 51, the washers 54 bonded to the respective ends of the annulus and received over the bolt 60 in contact with the mutually facing sides of the panel 20 and the frame 22 respectively, and the nut 62 for applying tension to the bolt to draw the washers 54 into abutment with the ends of the sleeve 58. In the illustrated and preferred arrangement, the support means comprise the two identical bushings 50 and 51, although an integral structure comprising both bushings may be substituted.

In operation, the principal vibratory motion of the agitator assembly is in the parallel direction of the arrows 72. In the event that a component of motion occurs in the normal direction, the stress changes in the rubber-like bodies 52 and 53 of the respective bushings 50 and 51 occur in opposite senses. That is, if the motion of the assembly is in a direction such that the normal stress in the body 52 of the bushing 50 is increasing, the normal stress in the body 53 of the bushing 51 will be decreasing and vice versa.

In practice, the dimensions of the parts are so arranged that whenever the assembly is in motion in the normal direction at least one of the bodies 52 or 53 will be under compression with increasing compressive stress and this bushing will, under these conditions, substantially relieve the stress on the other body and thereby minimize the damaging effect of tensile stresses in the latter.

In a preferred embodiment of the invention the length of the sleeve 58 is less than the distance between the mutually facing surfaces of the washers 54 when the bodies 52 and 53 of both of the bushings are allowed to assume an unstressed condition. As a result, during assembly when the nut 62 is tightened on the bolt 60 to bring the washers into firm contact with the ends of the sleeve 58, both of the bodies 52 and 53 are placed under compressive stress. The effect of this is that for at least certain positions of the vibrator assembly during a cycle of normal vibration, both of the bushings are under compressive stress and the portions of the cycle during which either bushing is under tensile stress are shortened. It will be apparent also that if the sleeve is shorter, by more than the extremity-to-extremity excursion of the normal movement, than the distance between the washers when the bodies 52 and 53 are in the unstressed condition, both of the bodies will be sufficiently compressed that neither will undergo tensile stress at any time during a vibratory cycle. Thus the invention limits or eliminates the adverse effects of tension on the bushings.

In operation, if wear or rupture should be noted in the rubber body 52 of the outer bushing 50, this bushing may be replaced while retaining the bushing 51 in position to prevent the loss of particulate material. At the same time, the bushing 51 may be inspected, and if it is found to be worn, a replacement of the bushing 51 may be scheduled for a time when the hopper 12 is empty of particulate material.

In cases where vibrator assemblies have been installed in hoppers or the like with the use of mounts like those described in the above-mentioned Pat. No. 3,715,059, it is relatively simple to replace such mounts with mounts constructed according to the present invention. It is merely necessary to remove the bolts 48 and the nut 62 with its washer 64, substitute the bushings 50 and 51 for the existing bushings, and reassemble the parts as shown.

Figure 4:
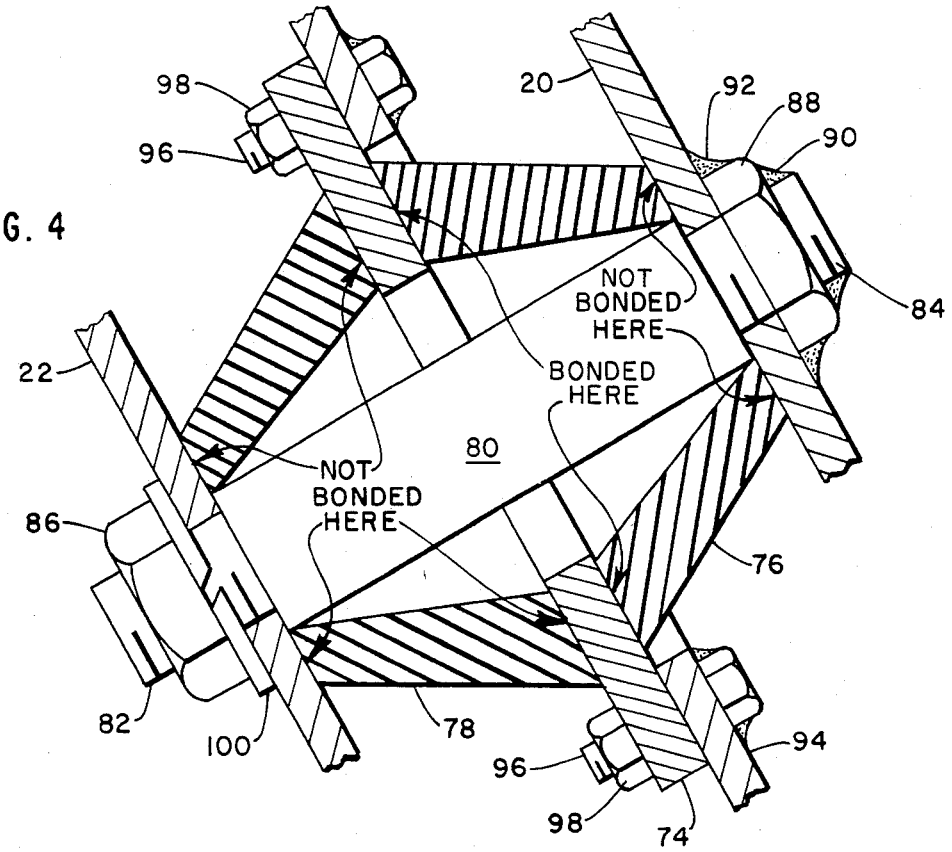
FIG. 4 is an enlarged fragmentary elevation similar to FIG. 3, illustrating a second embodiment.

FIG. 4 illustrates certain variations in the structure of a mount according to this invention. A single flange 74 is used in place of the two flanges 56. A rubber body 76 is bonded to the flange 74 and extends into contact with the vibrator panel 20 but is not bonded thereto. A body 78 extends between the flange 74 and the vibrator frame 22 but is not bonded to either the flange or the frame 22. A cylindrical spacer 80 having reduced, threaded ends 82 and 84 has annular shoulders respectively abutting the panel 20 and frame 22 with the portions 82 and 84 received through holes in these elements. Nuts 86 and 88 serve to draw the panel 20 and frame 22 firmly against the shoulders on the spacer 80, thereby applying compression to the bodies 76 and 78.

For convenience in assembly, the spacer is preassembled to the panel 20 by tightening the nut 88 and welding it to both the spacer and the panel as shown at 90 and 92, respectively. In assembly, after the panel 20 has been placed in position within the hopper wall 94, the flange 74 with attached body 76 are placed in position over bolts 96 and nuts 98 are applied. The assembly of the frame is then completed by simply slipping the body 78 over the spacer 80, followed by the frame 22, a lock washer 100 and the nut 86.

It will be apparent from the foregoing description that although the elastomeric bodies 52, 53, 76 and 78 have been shown as of conical configuration, whereby they engage the panel 20 and frame 22 at points immediately adjacent the spacer, they may be of cylindrical or other sleeve-like configuration, and they may bear upon the panel and frame at points spaced in relation to the spacer.

It will be evident from a consideration of FIGS. 3 and 4 that other variations in the structures of the parts comprising the bushings may also be incorporated consistently with the teachings herein, and without departing from the spirit or scope of this invention.

I claim:

1. A particulate material agitator comprising, in combination, an agitator panel formed to extend in generally parallel spaced relationship to and within a wall of a conveyor for said material, an agitator frame external to said wall and having a powered vibrator thereon, an elongate spacer extending through an aperture in said wall and rigidly securing the panel and frame together in spaced relationship, the agitator being adapted for vibrating the panel and frame predominantly in a direction parallel to said wall, and a mount including annular flange means adapted for attachment to said wall about said aperture and an elastic annulus of sleeve-like form extending from the flange means in opposite directions along the extent of the spacer to ends of said annulus respectively terminating at opposing surfaces of the frame and panel, said annulus being compliant to movement of the frame and panel in directions both parallel and normal to said wall.

2. The combination of claim 1, in which the spacer is dimensional to compress the annulus to a dimension less than its unstressed length between said opposing surfaces.

3. The combination of claim 2, in which the unstressed length of the annulus is sufficiently greater than the distance between said opposing surfaces to cause all portions of the annulus to remain under compression throughout a predetermined vibratory movement of the spacer in said normal direction.

4. The combination of claim 1, in which the spacer comprises a bolt extending through the panel and frame, a tubular sleeve surrounding the bolt and extending between the panel and frame, and means for applying tension to the bolt to draw the sleeve into abutment with the panel and frame.

5. The combination of claim 1, in which a portion of the annulus is bonded to the flange means and extends to the panel.

6. The combination of claim 1, in which at least end of the annulus is provided with a washer bonded thereto and received over the spacer.

7. The combination of claim 1, in which the support means comprise a pair of coaxial abutting annular members each comprising elastic material of sleeve-like form, said pair of members extending in opposite directions from said flange means.

8. The combination of claim 7, in which the elastic material of the sleeve-like members is of conical form.

9. The combination of claim 7, in which one of said pair of members is bonded to the flange means and extends to the panel.

10. The combination of claim 7, in which one end of each of said pair of members is bonded to the flange means and the other end is provided with a washer bonded thereto and received over the spacer.

11. The combination of claim 7, in which said pair of members are substantially identical in structure.

12. The combination of claim 1, with means to apply a resilient force between said wall and frame in a direction having a component opposed to the weight of the agitator.

* * * * *

UNITED STATES PATENT AND TRADEMARK OFFICE

CERTIFICATE OF CORRECTION

PATENT NO. : 4,522,500

DATED : June 11, 1985

INVENTOR(S) : Frank S. Hyer

It is certified that error appears in the above-identified patent and that said Letters Patent is hereby corrected as shown below:

Column 6, line 57, cancel "dimensional" and substitute --dimensioned--.

Column 7, line 8, after "least" insert --one--.

Signed and Sealed this

Thirtieth Day of December, 1986

*Attest:*

DONALD J. QUIGG

*Attesting Officer*

*Commissioner of Patents and Trademarks*